US005720241A

United States Patent [19]

Gail

[11] Patent Number: 5,720,241

[45] Date of Patent: Feb. 24, 1998

[54] ROTARY CYLINDER ENGINE

[76] Inventor: Josef Gail, Klausenweg 4, 86551 Aichach-Unterwittelsbach, Germany

[21] Appl. No.: 392,764

[22] PCT Filed: Aug. 27, 1993

[86] PCT No.: PCT/EP93/02325

§ 371 Date: Feb. 23, 1995

§ 102(e) Date: Feb. 23, 1995

[87] PCT Pub. No.: WO94/05902

PCT Pub. Date: Mar. 17, 1994

[30] Foreign Application Priority Data

Aug. 28, 1992 [DE] Germany ..... 42 28 639.5

[51] Int. Cl.[6] ..... F02B 57/08

[52] U.S. Cl. ..... 123/44 C

[58] Field of Search ..... 123/43 R, 44 R, 123/44 C, 65 BA

[56] References Cited

U.S. PATENT DOCUMENTS

| | | | |
|---|---|---|---|
| 3,477,415 | 11/1969 | Wyssbrod . | |
| 3,521,533 | 7/1970 | Van Avermaete | 123/44 C |
| 3,599,612 | 8/1971 | Villella . | |
| 3,739,756 | 6/1973 | Villella | 123/44 C |
| 4,010,719 | 3/1977 | Lappa | 123/44 C |
| 4,038,949 | 8/1977 | Farris | 123/44 C |
| 4,094,278 | 6/1978 | Franke | 123/44 C |
| 4,136,646 | 1/1979 | Lappa | 123/44 C |

FOREIGN PATENT DOCUMENTS

| | | |
|---|---|---|
| 2639676 | 6/1990 | France . |
| 12807 | 5/1880 | Germany . |
| 854283 | 8/1952 | Germany . |
| 2339958 | 2/1974 | Germany . |
| 3619612 | 12/1987 | Germany . |
| 3919168 | 12/1990 | Germany . |
| 113158 | 2/1918 | United Kingdom . |
| WO8703042 | 5/1987 | WIPO . |
| WO8808483 | 11/1988 | WIPO . |
| WO9015918 | 12/1990 | WIPO . |

OTHER PUBLICATIONS

Hydraulics & Pneumatics, Jul. 1989, p. 49.

*Primary Examiner*—Marguerite McMahon
*Attorney, Agent, or Firm*—Baker & Botts

[57] ABSTRACT

A rotary cylinder machine, designed as a two-cycle internal combustion engine or as a compressor, includes in a housing (1) a cylinder rotor (5) that rotates about a first axis of rotation (7) and has three pairs of cylinders (13), the cylinders of each pair being coaxial and on opposite sides of the first axis of rotation and the pairs being spaced apart circumferentially by 120°. The radially outer ends of the cylinders are closed by cylinder covers (33). Three pairs of pistons (15), rigidly connected together by piston rods (17), are carried on a crankshaft (21) that is rotatable about a second axis of rotation (23) that is parallel to and eccentric to the first axis of rotation (7). The piston rods (17) are seated on three eccentric disks (25), likewise displaced 120° with respect to one another, on the crankshaft (21). Gas exchange takes place through piston-controlled ports (51, 53) of the cylinders (13). In the gas-exchange path of the ports (51, 53) rotary slide valve control arrangements (57), which optionally control gas exchange together with the piston-controlled ports (51, 53), are provided on at least the exhaust side. Gas intake may take place through rotary slide valve controls, or through an intake channel terminating in a crankshaft chamber of the cylinder rotor (5) and connected with the intake ports by overflow channels. In an internal combustion engine, a blower driven by a variable-speed motor may be provided for control of the degree of filling of the combustion chambers (37).

10 Claims, 6 Drawing Sheets

ROTARY CYLINDER ENGINE

BACKGROUND OF THE INVENTION

The invention concerns a rotary cylinder machine and, in particular, a two-cycle internal combustion engine or a compressor of the rotary cylinder type.

A two-cycle internal combustion engine of the rotary cylinder type is disclosed in U.S. Pat. No. 3,739,756. This internal combustion engine comprises a cylinder rotor having a plurality of cylinders arranged at like angular distances apart about the axis of rotation of the cylinder rotor. The pistons, radially displaceable in the cylinders, are supported by articulated connecting rods on a single common eccentric bearing of a crankshaft firmly connected with a housing surrounding the cylinder rotor. Intake and exhaust ports which, as customary in two-cycle internal combustion engines, are controlled, i.e., opened and closed, by the radially outer edge of the piston, are provided in the cylinders for gas exchange. Stationary gas exchange channels are provided in the side walls of the housing axially on either side of the cylinder rotor, past which cylinder-side gas-exchange channels, ending at one end at the gas-exchange ports, in each instance move at their other end, like a rotary slide valve control, in the course of rotation of the cylinder rotor.

The two-cycle internal combustion engine disclosed in U.S. Pat. No. 3,739,756 differs from conventional engines of the star type of construction wherein the pistons, displaceable in cylinders arranged starlike radially but stationary, work on a rotating crankshaft, essentially in that in the internal combustion engine of U.S. Pat. No. 3,739,756 the crankshaft is stationary and the cylinders rotate instead. In engines of this type the length of stroke is comparatively great relative to the diameter of the pistons, with the result that in gas exchange comparatively long combustion chambers must be scavenged and filled in the direction of travel of the piston. It is relatively difficult to ensure sufficient scavenging of the combustion chambers, particularly since the peripheral surface of the cylinder available for the accommodation of gas-exchange ports is limited. Added to this is the fact that the kinematics of the crankshaft drive used there produces asymmetries of lifting motion, which also has an effect on the control angles and/or control times available for gas exchange. Lastly, the kinematics of articulated control rods has the effect that the radial thrust force of the piston cannot be optimally converted into a torque acting on the cylinder rotor, owing to which the utilization of power is reduced.

International Application WO90/15918 discloses another rotary cylinder machine usable as an internal combustion engine or as a compressor. The engine has a cylinder rotor, rotating about a first axis of rotation, which comprises three cylinder pairs displaced 120° with respect to one another. The cylinders of each pair, running radial to the first axis of rotation, are arranged coaxial and are rigidly connected together by a common piston rod. The cylinder rotor surrounds a stationary housing in which a crankshaft surrounded by the cylinders is seated for rotation about a second axis of rotation arranged with a predetermined eccentricity to the first axis of rotation. The piston rods of each piston pair are each supported for rotation on an eccentric bearing of the crankshaft, whose eccentric disk is firmly connected with the crankshaft. The eccentric bearings define third axes of rotation, displaced at an angle of 120° with respect to one another about the second axis of rotation, whose radial distance from the second axis of rotation is likewise equal to the predetermined eccentricity. In this way each piston pair, relative to the eccentric shaft, is supported fixed against rotation on the cylinder rotor even when its eccentric shaft momentarily coincides with the axis of rotation of the cylinder rotor. Support is effected exclusively through the two other piston pairs, without the cylinder rotor additionally having to be coupled, fixed against torque, by way of a gear or the like with the crankshaft. Since the eccentric bearings define axes of rotation stationary relative to the crankshaft, the piston rods do not have to be supported articulated by double bearings on the piston as well as on the crankshaft. The known rotary cylinder machine may be made comparatively small, relative to its output.

In the rotary cylinder machine disclosed in WO90/15918 the cylinders are open toward the periphery of the cylinder rotor and are closed off from the outside by the housing which closely surrounds the cylinder rotor. In the surface region of the housing overlapping gas-exchange ports are provided in a part of the path of rotation of the cylinder. In such a design, to prevent pressure losses the housing surrounding the cylinder rotor must have a tolerance with a minimal annular clearance, or else sealing elements must be used. Reliable sealing by means of an annular clearance with close tolerance is very difficult to achieve because of unlike thermal expansions, particularly when the engine is designed as an internal combustion engine, and a reliable seal with sealing strips or the like leads to problems because of the high running speeds present at the outer periphery.

SUMMARY OF THE INVENTION

A first object of the invention is to procure a rotary cylinder machine, designed as a two-cycle internal combustion engine which, with comparatively small dimensions, has a high output.

The aforesaid object of the invention may be obtained in a variety of aspects. All aspects are based on the consideration that the sealing problems of the rotary cylinder internal combustion engine disclosed in WO90/15918, which result from the cylinders of the cylinder rotor being open radially outward to the gas-exchange control, can be avoided without reducing the advantageous volume/output ratio of this known internal combustion engine when the engine is designed as a two-cycle internal combustion engine with cylinders firmly closed by cylinder covers, in other words, when gas-exchange control is effected by piston-edge-controlled ports in the side wall of the cylinder.

In this connection, the invention starts out from a rotary cylinder engine designed as a two-cycle internal combustion engine including the following features:

a housing, a crankshaft in the housing, at least one cylinder rotor, seated for rotation in the housing about a first axis of rotation, having a plurality of cylinders closed radially outside by cylinder covers firmly connected with the cylinder rotor and arranged at like angular distances apart about the first axis of rotation and the crankshaft, with cylinder axes running radial to the first axis of rotation, a piston in each cylinder, displaceable radially to the first axis of rotation, which together with its cylinder cover and the piston delimits a combustion chamber, the pistons being connected by piston rods with eccentric bearings of the crankshaft, and a gas-exchange control with intake and exhaust gas-exchange channels assigned separately to the individual cylinders, one end of which in each instance terminates in at least one gas-exchange port in the cylinder which is controllable by the radially outer edge of the piston relative to the first axis of rotation.

In a first aspect of the invention there is provided, in addition to the port control of gas exchange, another rotary slide valve control arrangement, rotating synchronously with the cylinder rotor, between at least one gas-exchange channel stationary relative to the housing and the ends of the cylinder-side intake gas-exchange channels and/or exhaust gas-exchange channels distant from the port. Here the essential concept of the invention is realized in that the cylinder rotor comprises three pairs of cylinders, arranged coaxially and displaced at an angle of 120° with respect to one another, whose pistons are likewise rigidly connected together in pairs by means of piston rods, in that the crankshaft is supported for rotation about a second axis of rotation displaced parallel to the axis of the first axis of rotation with a predetermined eccentricity and the eccentric bearings define third axes of rotation for the piston rods of piston pairs, displaced at an angle of 120° about the second axis of rotation and displaced by the predetermined eccentricity parallel to the axis of the second axis of rotation.

Two-cycle internal combustion engines of the rotary cylinder type according to the invention have a comparatively short piston stroke with a comparatively great stroke volume of individual combustion chambers. The short stroke makes exact sizing of the opening and closing angles difficult. In addition, as is customary in two-cycle internal combustion engines, the opening and closing angles of the intake ports and exhaust ports are symmetrical to the radially inner dead-center position and the radially outer dead-center position of the piston. This symmetry may lead to scavenging losses, i.e., to the escape of unused fuel or insufficient scavenging and insufficient fill of fresh gas. In the first aspect of the invention, a further object of the invention is to obtain the above mentioned object of the invention with optimal gas-exchange control. For this purpose, it is provided that the aforementioned rotary slide valve control arrangement likewise controls the gas exchange of the individual cylinders and varies, in particular reduces, the resulting opening control angle of the intake and/or exhaust gas-exchange channel, relative to the rotation of the cylinder rotor, compared with the opening control angle of the associated cylinder-side gas-exchange port. The rotary slide valve control arrangement, which may be provided in the path of the intake channels as well as of the exhaust channels and in both channels, assumes gas-exchange control together with the piston-controlled ports. The distance of the rotary slide valve control arrangement from the gas-exchange ports provides a reduction of gas pressure, in particular on the exhaust side, so that the rotary slide valve control arrangement must meet only limited sealing requirements. In particular, however, the rotary slide valve control arrangement makes it possible to establish beginning of intake and end of intake independently of beginning of exhaust and end of exhaust, so that the gas exchange can be optimized.

In a preferred embodiment, the rotary slide valve control arrangement comprises a slide valve part having a control opening, movable in the peripheral direction of the cylinder rotor relative to the latter, which during gas exchange connects the end of the cylinder-side gas-exchange channel distant from the port with the stationary gas-exchange channel. The slide valve part, which, for example, is a ring surrounding the crankshaft, permits adjustment of the gas exchange, advantageously in that a drive mechanism permits displacement of the slide valve part when the cylinder rotor is rotating, i.e., during operation of the machine.

The rotary slide valve control arrangement may be realized using side faces formed integrally by the cylinder rotor or the housing. However, the rotary slide valve arrangement preferably comprises pairs of annular sealing disks, resting sealingly on one another and in particular preloaded axially elastically against one another, arranged axially lateral to the cylinder rotor, at least one of which advantageously consists of ceramic material. The elastic preloading provides sufficient sealing force. However, the sealing disks, on sides facing one another, preferably have coaxial annular interlocking projections which form a sealing labyrinth between the sealing disks. In this way a reliable rotary slide valve control arrangement can be obtained with little expenditure on structural parts. The ends of the cylinder-side gas-exchange channels distant from the ports preferably are a shorter distance away from the first axis of rotation than the associated gas-exchange ports. In this arrangement the cylinder-side gas-exchange channels extend to the axis of rotation of the cylinder rotor, so that the diameter of the rotary slide valve control arrangement can be kept small and hence the relative speed of the sealing faces moving against one another can be kept low.

If the rotary slide valve control arrangement is provided on the intake side, a layer charge can be obtained without great technical effort. For this purpose, in a preferred embodiment, it is provided that the rotary slide valve control arrangement assigned to the intake gas-exchange channels successively connects the intake gas-exchange channels with an intake channel for fresh air, stationary relative to the housing, and a likewise stationary intake channel for the air-fuel mixture. This two-part gas intake design allows the scavenging process of the stroke volume to be begun exclusively with fresh air to avoid scavenging losses in gas exchange, so as to supply mixture continuously as rotation proceeds.

In conventional internal combustion engines of the rotary cylinder type controls similar to rotary slide valves are provided on the intake side as well as on the exhaust side. Although such rotary slide valve control arrangements are used as an element in the invention in addition to gas-exchange controls with piston-controlled gas-exchange ports, it may be of advantage to reduce the number of rotary slide valves required. In a second aspect, the object of the invention is to facilitate, in simple fashion, the sealing of a cylinder rotor with respect to the housing surrounding it.

Starting out from the two-cycle internal combustion engine described at the beginning, this is obtained in that the cylinder rotor encloses a central crankshaft chamber containing the crank-shaft, from which the cylinders proceed, in that the intake gas-exchange channels are designed as overflow channels open to the crankshaft chamber, and in that within a bearing supporting the cylinder rotor for rotation on the housing a gas-intake channel, stationary relative to the housing, runs radially into the crankshaft chamber.

Such a rotary cylinder internal combustion engine requires no intake-side rotary slide valve. The fresh gases are conveyed, through a channel running through the rotary cylinder bearing and stationary relative to the housing, into the crankshaft chamber, from where they pass piston-controlled through the overflow channels into the combustion chambers of the cylinders.

On the exhaust side there is advantageously provided a rotary slide valve control arrangement which again preferably is also used for gas-exchange control, but alternatively may be used only for controlled conveyance of the exhaust gases through the housing.

In a preferred embodiment of this aspect of the invention it is provided that the pistons are wider in the axial direction of the cylinder rotor than in its peripheral direction. Here the exhaust gas-exchange ports are in each instance provided in a wall region of the cylinder running substantially in the axial direction of the cylinder rotor, in particular at least approximately in the center of this wall region, and in the axial direction of the cylinder-rotor intake gas-exchange ports are provided on both sides of the exhaust gas-exchange ports. In such a configuration the combustion chamber is traversed by gases in counterflow, the fresh gases entering in the region of the longitudinal ends of the combustion chamber, preferably so that they flow substantially along the wall regions of the cylinder running in the peripheral direction to the cylinder cover, and from there flow back in the center region of the combustion chamber to the exhaust gas-exchange ports. To support this reversing effect, the cylinder cover advantageously has two concavely curved arches lying side by side in the axial direction of the cylinder rotor. It has likewise proven to be advantageous when two spark plugs are assigned to the cylinder, each working in one of the two arches, that the cylinders in addition preferably have exhaust gas-exchange ports as well as intake gas-exchange ports in the peripheral direction on both sides of the pistons. This design, made possible by the crank chamber charge of the cylinder in particularly simple fashion, imparts symmetry to the gas-exchange flows on the intake side as well as on the exhaust side, which helps optimize gas exchange.

However, the use of pistons which are wider in the axial direction of the cylinder rotor than in its peripheral direction is of advantage not only in two-cycle internal combustion engines with crank chamber charge. This piston design generally, that is, in rotary cylinder machines designed other than as internal combustion engines or as compressors, facilitates accommodation of the cylinders in the cylinder rotor, since stroke volume can be increased without the diameter of the cylinder rotor having to be increased.

So far as a longitudinal piston shape is under discussion above and also below, this is a one-piece piston with an elongated shape in the axial direction of the cylinder rotor in the top view of its cover. In a preferred embodiment, which may likewise be used generally in rotary cylinder machines and therein permits a favorable stroke volume relative to the diameter of the cylinder rotor to be used, it is provided that each cylinder comprises two circular cylindrical cylinder chambers, arranged side by side in the axial direction of the cylinder rotor, which are separated from one another by a separating wall provided in the region of the cylinder cover with at least one overflow opening, where in each instance one of the cylinder chambers is connected only with the intake gas-exchange channel and the other cylinder chamber is connected only with the exhaust gas-exchange channel, and that one of two partial pistons of a double piston is displaceable in each cylinder chamber. Application of the double-piston principle, known per se, to a rotary cylinder machine permits the use of cylindrical in contrast to longitudinal pistons and hence pistons which are comparatively simple to seal.

In application of the double-piston principle to an internal combustion engine, overflow channels preferably are provided in the peripheral direction of the cylinder rotor on both sides of one cylinder chamber and exhaust gas-exchange ports in the peripheral direction of the cylinder rotor on both sides of the other cylinder chamber. In this way, scavenging behavior can be improved when the machine is designed as a two-cycle engine.

The two partial pistons of each double piston advantageously are connected by separate piston rods with the two partial pistons of the double piston radially opposed relative to the first axis of rotation, the two piston rods of each double piston pair being supported on two eccentric bearings arranged at some distance apart in the direction of the second axis of rotation. Support of the partial pistons on separate eccentric bearings facilitates mounting. It is understood that even in the case of longitudinal pistons of the type described above each piston rod may consist of two parts arranged at some distance apart, which in turn are supported on two separate eccentric bearings arranged at some distance apart from one another. The feature of the piston rod and of the eccentric bearing supporting the piston rod is intended alternatively to include multiple-part piston rods and eccentric bearings optionally arranged at an axial distance apart.

However, the elongated piston shape described above also has importance in a second independent aspect of the invention. Conventional internal combustion engines of the cylinder-rotor type usually have cylindrical pistons, where the intake gas-exchange ports and exhaust gas-exchange ports are provided on diametrically opposite sides of the associated cylinders. In association with the long stroke usual in conventional internal combustion engines of the rotary cylinder type, the flow path of the gases through the cylinder is short. This may lead to scavenging losses. Therefore, another object of the invention is to provide a stroke volume favorable to combustion in a two-cycle internal combustion engine of the rotary cylinder type.

This is obtained in that the pistons are wider in the axial direction of the cylinder rotor than in its peripheral direction and in that the intake gas-exchange ports on the one hand and the exhaust gas-exchange ports on the other are provided on opposing sides of the cylinders in the axial direction of the cylinder rotor. Particularly when the pistons have a piston head arched convexly at least in the axial direction of the cylinder rotor and the cylinder cover is arched concavely at least in the axial direction of the cylinder rotor, direct-flow scavenging favorable to combustion is produced. The pistons, in the peripheral direction of the cylinder rotor, preferably have substantially plane outer surfaces, running parallel to the axis of the first axis of rotation, which on the narrow sides become semicylindrical outer faces. Pistons of this shape can be sealed off comparatively simply and are simple to produce as well. Also of advantage is that the inflow and outflow region can be designed without eddy-forming corners in the region of the ports of the cylinder provided on the narrow sides.

In one preferred embodiment, which is also of advantage especially for the embodiments of the rotary cylinder machine described above with pistons or double pistons extended in axial direction, the value of the predetermined eccentricity of the crankshaft described at the beginning is sized so that four times the value of the eccentricity is less than the maximum width of the pistons in the peripheral direction of the cylinder rotor, i.e., in pistons extended axially is less than the width of the narrow side of the piston. This sizing rule advantageously is applied in cylindrical pistons as well, since it permits an optimal volume/output ratio.

In a third aspect of the invention, the comparatively great stroke volume of the individual cylinders, particularly when pistons extended axially are used, permits control of the degree of fill of the cylinder with fresh gases when the intake gas-exchange channel is connected with a blower whose drive includes a speed-controllable motor, in particular an electric motor. Variation of the speed of the blower permits its delivery to be varied and hence the degree of fill of the cylinder to be adapted to the instantaneous speed of the cylinder rotor.

A speed control responding to the speed of the cylinder rotor optionally may be provided for the blower motor. Thus optimization of output of the two-cycle internal combustion engine can be obtained in this aspect of the invention as well.

In a preferred embodiment of the internal combustion engine according to the invention explained in a variety of aspects, it is provided that the housing completely encloses the cylinder rotor and forms a blower housing with at least one cooling-air intake in the region of its center and at least one outlet in the region of its outer periphery. As is customary in air-cooled engines, the cylinders may be provided with fins for the formation of a great heat exchange surface, around which in the said mode of arrangement of the cooling-air openings the air flows radially to the axis of rotation of the cylinder rotor. Air flow may alternatively be intensified by an external cooling-air blower. The cooling-air intake opening preferably is situated in the region of the exhaust rotary slide valve control arrangement, so that it can also be used for cooling thereof. To enlarge the heat-exchange surface the flow of cooling air advantageously is conveyed through channels passing radially by the rotary slide valve control arrangement in the inside of the blower housing.

Since the cylinder rotor is enclosed by the blower housing, a considerable reduction in noise emission is obtained at the same time. To this end, the blower housing optionally may be provided on the outside with a suitable sound-reducing coating.

The small size of the two-cycle internal combustion engine according to the invention, in combination with its high output and, thanks to its low piston speeds, high operating reliability and service life, opens up numerous areas of application. Special advantages are obtained in a stationary mode of operation, wherein the internal combustion engine is coupled with a machine, in particular an electric generator or the compressor of a heat pump. These areas of applications call for low machine maintenance and high reliability of operation and small noise emission. The exhaust gas-exchange channel of the internal combustion engine preferably is connected with a heat exchanger, so that not only can the heat pump be used for heat generation of a building heating system, but the exhaust heat of the internal combustion engine can also be used for heating purposes. Since the speed of the crankshaft is twice as great as the speed of the rotor, a more favorable drive speed, for example for a three-phase-current generator, is likewise obtained without a step-up gear being required.

Another aspect of the invention concerns a rotary cylinder machine designed as a compressor. WO90/15918 discloses a compressor of the rotary cylinder type whose pistons corresponding to the internal combustion engine of the rotary cylinder type explained in a variety of aspects are supported in pairs by rigid piston rods on eccentric bearings of a crankshaft for rotation in a housing. The pistons travel in radial cylinders of a cylinder rotor rotatable eccentric to the axis of the piston. The cylinders are sealed off radially outward by a peripheral wall of the housing, which alternatively contains control ports, running in the peripheral direction, for gas intake and gas exhaust. The cylinders are closed off from the crankshaft by baffles, the piston rods penetrating these baffles displaceably. In addition, between the compressor chambers between the peripheral wall and the outer side of the pistons additional compressor chambers are formed in this way between the inner side of the pistons and the baffles, for the control of which gas-exchange channels are provided in the axially lateral walls of the cylinder rotor in the region of the baffles, which channels communicate with control ports of the housing circularly surrounding the axis of rotation of the cylinder rotor. The axially lateral control ports are connected with the control ports provided in the peripheral wall of the housing, so that the inner compressor chambers form a preliminary compressor for the outer compressor chambers.

As already described above for the design of the rotary cylinder machine as an internal combustion engine, to prevent pressure losses the housing surrounding the cylinder rotor must have a tolerance with an annular clearance, albeit small, or else sealing elements must be used. Because of unlike thermal expansion, however, annular clearances with sufficiently close tolerance can be realized only with difficulty and even reliable sealing with sealing strips or the like likewise leads to problems, because of the high running speed present at the outer periphery.

An object of the invention is to indicate a rotary cylinder machine designed as a compressor, which alternatively is permanently sealed off for high compressor output.

Here, the invention proceeds from a compressor of the type disclosed in WO90/15918, wherein the cylinder rotor contains three piston pairs, displaced 120° with respect to one another, in radial cylinders of its cylinder rotor and wherein the cylinder rotor is arranged eccentric to a crankshaft connected by way of rigid piston rods to the piston pair. To accomplish the object indicated above, the cylinders are closed radially outside by cylinder covers firmly connected with the cylinder rotor, and for gas exchange, instead of control ports arranged in the peripheral wall of the housing surrounding the cylinder rotor, a rotary slide valve control arrangement for controlling the gas exchange of the individual cylinders is provided axially on at least one side of the cylinder rotor. Here, the gas-exchange channels of the individual cylinders, rotating together with the cylinder rotor, run from the region of the cylinder cover to a region, situated radially further inside, of the axially lateral wall of the cylinder rotor containing the rotary slide valve control arrangement. Since the cylinders are closed radially outward by fixed cylinder covers, sealing problems in the region of the cylinder rotor periphery exposed to high relative speeds are avoided. But comparatively high relative speeds are likewise avoided in the region of the rotary slide valve control arrangement as well, since the gas-exchange channels rotating with the cylinder rotor run radially inward, wherewith the sealing faces of the rotary slide control arrangement can be arranged on a comparatively small radius.

As already explained in connection with the two-cycle internal combustion engine, the rotary slide valve control arrangement can alternatively be realized in the case of the compressor with the use of side faces formed integrally by the cylinder rotor or the housing. Here, too, however, the rotary slide valve control arrangement preferably comprises pairs of annular sealing disks resting sealingly on one another and in particular elastically preloaded axially with respect to one another, of which at least one advantageously consists of ceramic material. The elastic preloading provides sufficient sealing force. In a preferred embodiment, however, the sealing disks are provided on sides facing one another with coaxial annular interlocking projections which form a sealing labyrinth between the sealing disks, so that sufficient sealing effect is obtained even with comparatively little bearing pressure.

In a preferred embodiment of the compressor which is distinguished by especially low flow resistance in the region of the intake and/or exhaust gas-exchange channels, it is provided that in the direction of the first axis of rotation rotary slide valve control arrangements are provided on both sides of the cylinder rotor, which connect rotating gas-exchange channels provided in both axially lateral walls of the cylinder rotor by way of circular control ports alternately with stationary intake gas-exchange channels and stationary exhaust gas-exchange channels. Here the intake gas-exchange channels preferably are connected with a common intake opening, and the exhaust gas-exchange channels additionally or alternatively may be connected with a common exhaust opening.

To facilitate production of the housing, the housing preferably consists of two housing halves mirror-symmetrical to a dividing plane running perpendicular to the first axis of rotation. The dividing plane advantageously runs through the common intake and/or exhaust openings described above.

Manufacture of the cylinder rotor is facilitated in rotary cylinder machines designed both as internal combustion engines and as compressors when it comprises two rotor parts forming the cylinder walls, of which a first rotor part forms an axially lateral wall of the cylinder rotor and a peripheral wall jointly forming the cylinder covers, and the second rotor part forms an additional axially lateral wall and bears projections, projecting in axial direction, which between them delimit the cylinders in the peripheral direction. A cylinder rotor made in this way is not only sturdy, but the surfaces to be made with close tolerances are accessible essentially free of undercut, so that they can be machined exactly in simple fashion.

DESCRIPTION OF THE DRAWINGS

The invention is explained below in detail with the aid of the drawings, wherein.

DESCRIPTION OF THE EMBODIMENTS

Figure 1:
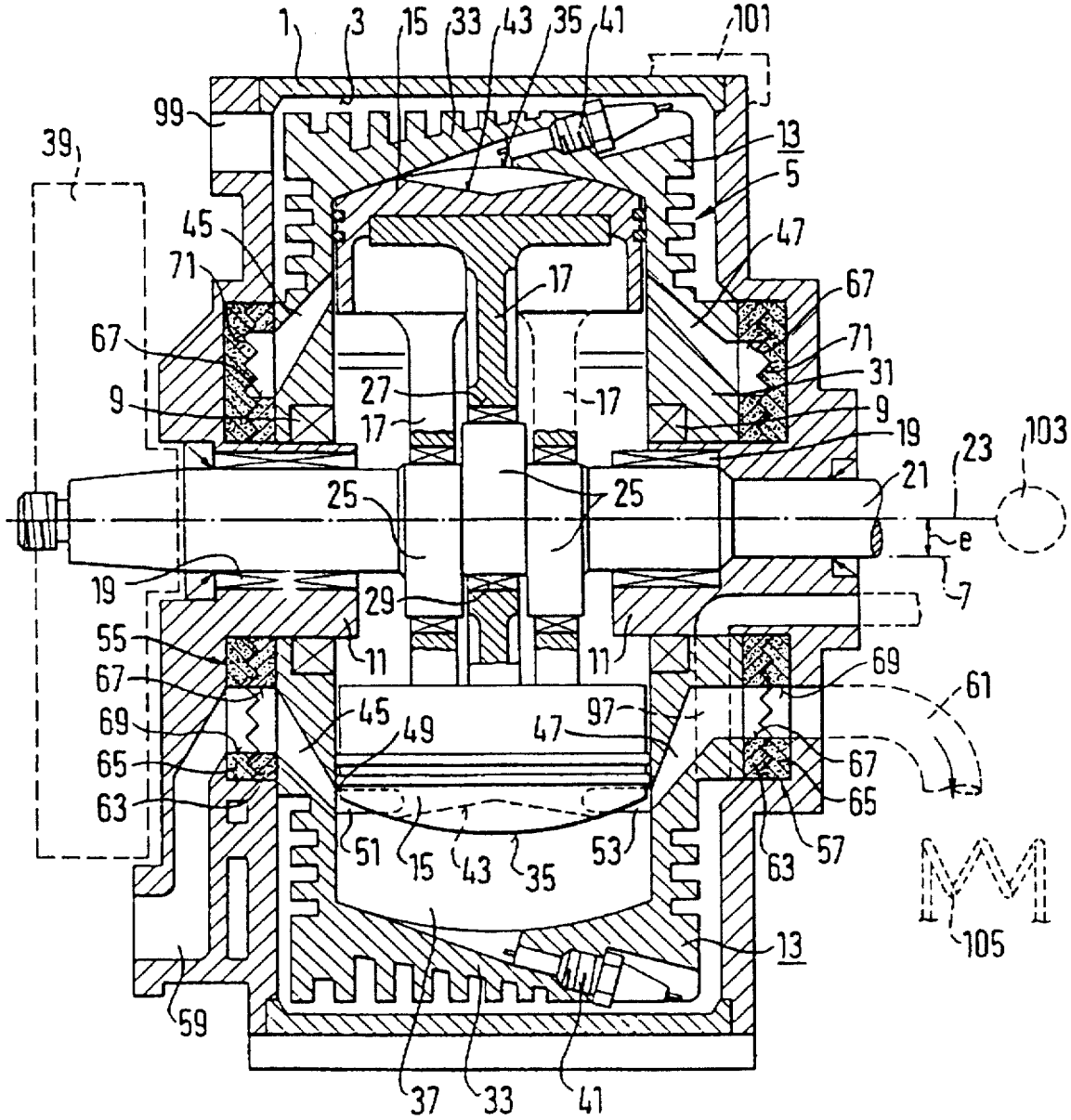
FIG. 1 an axial longitudinal section through a first embodiment of a two-cycle internal combustion engine of the rotary cylinder type according to the invention.
Figure 2:
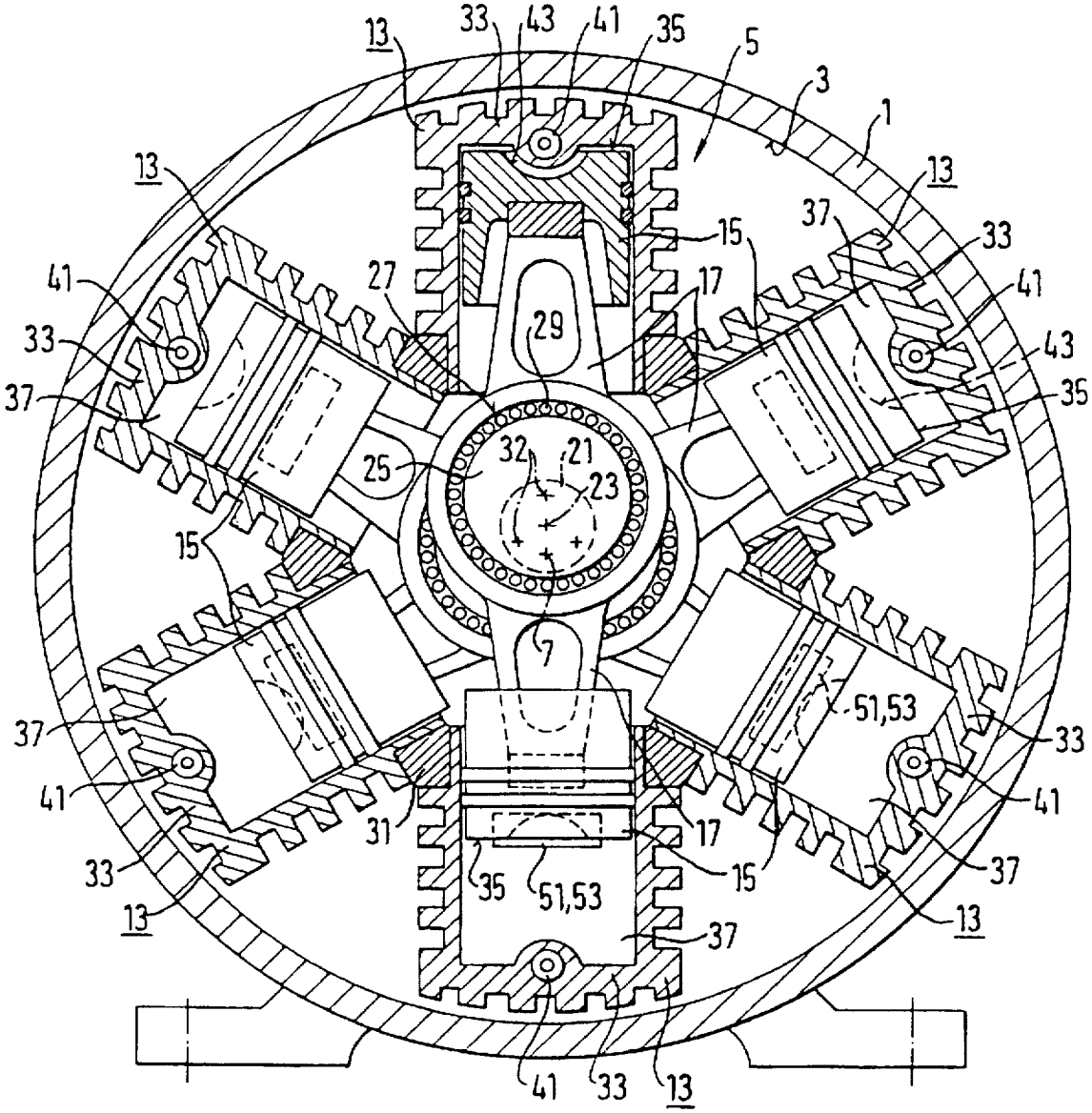
FIG. 2 a transverse cross section through the internal combustion engine.

The two-cycle internal combustion engine represented in FIGS. 1 and 2 comprises a housing 1 with an essentially cylinder-shaped inner chamber 3, in which a star-shaped cylinder rotor 5 is arranged for rotation about an axis of rotation 7. The cylinder rotor 5 is supported by rolling bearings 9 on bearing shoulders 11 of the housing 1.

The cylinder rotor 5 contains six cylinders 13, in each of which a piston 15 is arranged for displacement perpendicular to the axis of rotation 7. The cylinders 13 and pistons 15 are arranged flush with one another, i.e., coaxially, in pairs on opposing sides of the axis of rotation 7. Here the axes of the cylinder pairs are displaced at an angle of 120° with respect to one another about the axis of rotation 7 and advantageously lie in the same plane normal to the axis of the cylinder rotor. The pistons 15, assigned in pairs relative to one another, are rigidly connected together by piston rods 17.

In the housing 1, on rolling bearings 19, a crankshaft 21 is seated for rotation about an axis of rotation 23 displaced parallel to the axis of the axis of rotation 7 by an eccentricity e (FIG. 1). The crankshaft 21 supports stationary three eccentric circular disks 25, arranged axially side by side, which are seated in bearing openings 27 of the piston rods 17 and support the piston rods 17 by way of needle bearings 29. The eccentric circular disks 25 define eccentric bearings having eccentric axes of rotation 32 parallel to the axis of the axis of rotation 23 of the crankshaft 21 but displaced with respect to the axis of rotation 23 by the value of the eccentricity e. The eccentric axes of rotation 32 of the three eccentric circular disks 25 are likewise displaced at an angle of 120° with respect to one another about the axis of rotation 23. The eccentric circular disks 25 have a radius which is greater than the eccentricity e and preferably are connected together exclusively in their radially overlapping region.

As also described in detail in WO90/15918, in operation the pistons 15, upon rotation of the cylinder rotor 5, move about the axis of rotation 7 along a path which intersects the axis of rotation 7 in a plane normal to the axis. The eccentric axes of rotation 32, coinciding with the axis of the mid-point of the eccentric circular disk 25, likewise moves on this path. The three piston pairs are supported on the crankshaft 21 exclusively by their piston rods 17. Here the crankshaft 21 is forcibly rotated relative to the cylinder rotor 5, specifically at an angular speed which is twice as great as the angular speed at which the cylinder rotor rotates about its axis of rotation 7. Since the piston stroke is equal to four times the eccentricity e, in practice the eccentricity e is relatively small, for example in the order of magnitude of 10 to 20 mm. The radius of the eccentric circular disks 25 is smaller than four times the value of the eccentricity e and normally is about 2.5 to 3 times the value of the eccentricity e.

The cylinder rotor 5 has a central crankcase 31, seated on the bearings 9, to which the cylinders 13 are bolted. At the head side the cylinders 13 are closed by firmly connected cylinder covers 33 and, together with the cylinder cover 33 and a piston head of the pistons 15, represented at 35, in each instance delimit a combustion chamber 37 in which the pistons 15, rotating on a circular path, are shifted to and fro between a radially inner dead-center position and a radially outer dead-center position. Numeral 39 designates a flywheel supporting rotation, which may be held on the crankshaft 21. Spark plugs, indicated at 41, which project into recesses 43 of the piston head 35, are assigned to the combustion chambers 37. The recesses 43 at the same time form a compression chamber for the air-fuel mixture to be ignited by the spark plugs 41.

For gas exchange, i.e., the supply of fresh air-fuel mixture and escape of exhaust gases, there are provided, on axially opposing sides of the cylinder rotor 5 relative to the axis of rotation 23, in the individual cylinders 13, intake channels 45 and, relative to the cylinders 13, diametrically opposite exhaust channels 47. The intake channels 45 and exhaust channels 47 terminate, in a region of the cylinder wall not covered by the radially outer edge 49 of the piston skirt in the inner dead-center position of the piston 15, in at least one intake port 51 and at least one exhaust port 53. The ports 51, 53, designated generally as gas-exchange or scavenging ports, are opened and closed for control of gas exchange by the piston 15 in the course of the latter's lifting motion. The ports 51, 53 may be arranged at the same level; in the case of a piston 15 moving radially inward, however, the exhaust port 53 advantageously opens before the intake port 51.

Between the axial walls of the cylinder rotor 5 and the axially adjacent side walls of the housing 1 there are arranged rotary slide valve control arrangements 55 and 57, which connect the ends of the gas-exchange channels 45, 47 distant from the port with a stationary intake channel 59 provided on the housing side and an exhaust channel 61 arranged stationary to the housing 1 in a position in which the ports 51, 53 are open. However, the rotary slide valve arrangements 55, 57 not only form sealing housing passages for the cylinder-side intake channels 45 and exhaust channels 47 but, in combination with the ports 51, 53, control gas exchange, the rotary slide valve 55 reducing the actual intake opening time compared to the opening time determined by the intake port 51, in that the rotary slide valve 55, compared with the intake port 51, opens later and/or closes earlier. In the same way, the rotary slide valve 57 likewise additionally controls the exhaust opening time for the exhaust port 53, in that the exhaust rotary slide valve 57 opens later than the exhaust port 53 and/or closes earlier than the exhaust port 53.

Figure 3:
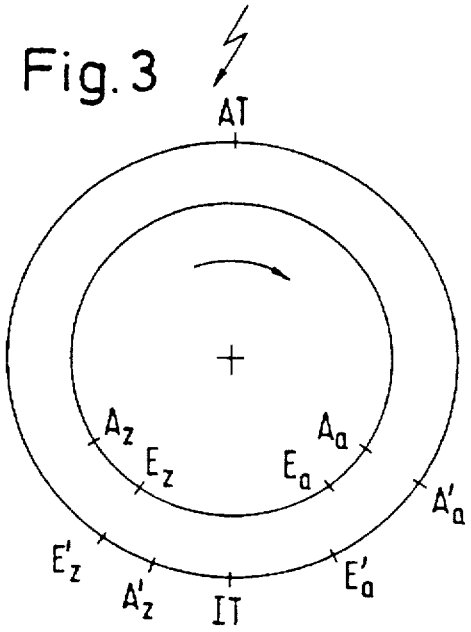
FIG. 3 a control diagram of the internal combustion engine.

In addition to the piston-controlled ports 51, 52, gas exchange can be influenced and optimized by means of the rotary slide valves 55, 57 for the prevention of scavenging losses or for improving charge of the combustion chamber with fresh gases. FIG. 3 shows a control diagram for one of the cylinders. AT designates the dead center lying radially outside and IT the inner dead center of the piston. Ignition takes place in the outer dead center. The control diagram is traversed clockwise, the control angle of 360° corresponding to one rotation of the cylinder rotor 5. The exhaust port 53 opens at time $A_a$, and the exhaust rotary slide valve 57 opens at the same time (time $A'_a$). This begins the exhaust phase. The intake port 51 opens at time $E_a$. The scavenging phase, however, begins after that in time, with opening of the intake rotary slide valve 55 at time $E'_a$. The scavenging phase ends with closing of the exhaust rotary slide valve 57 ($A'_z$). Since the rotary slide valve 57 closes before the intake port 51 (time $E_z$) and the intake rotary slide valve 55 (time $E'_z$) close simultaneously, scavenging losses are avoided. The exhaust port 53 closes in time after the end of intake at time $A_z$. The control diagram of FIG. 3 represents only an example. In a given case it may be sufficient when only the intake times or the exhaust times are varied, and accordingly either the intake rotary slide valve 55 or the exhaust rotary slide valve 57 may alternatively be omitted.

The rotary slide valves 55, 57 are designed substantially alike and in each instance comprise two annular sealing disks 63, 65 which are arranged side by side axially and pressed sealingly against one another axially. The sealing disk 63 adjacent to the cylinder rotor 5 is provided with openings 67 matching the ends of the gas exchange channels 45, 47 distant from the ports, while the sealing disk 65 distant from the cylinder rotor 5 in each instance has an opening 69 matching the gas exchange channel 59 or 61. The sealing disk 63 is connected fixed against rotation with the cylinder rotor 5 and, like the sealing disk 65 connected fixed against rotation with the housing 1, may consist of ceramic material. In order to obtain a dynamic seal, the sealing disks are provided, on their faces abutting axially on one another, with alternately interlocking annular projections or ribs 71 coaxial to one another, which together form a labyrinth seal. The rotary slide valves 55, 57 need not overcome any excessively high pressure peaks, since the ports 51, 53 assume preliminary control of gas exchange. Since the cylinder-side gas-exchange channels 45, 47, starting from the ports 51, 53, are sloped outward toward the axis of rotation 7, the diameter of the sealing disks 63, 65 may be kept relatively small, wherewith the relative sliding speed between the sealing disks 63, 65 remains low. In this connection, it is also of advantage that, compared with conventional internal combustion engines of the rotary cylinder type, the rotor speed is only half as great as the drive speed of the crankshaft 21. The rotary slide valves 55, 57 alternatively may be designed in some other fashion and, for example, instead of surfaces resting axially on one another, may have cylindrical or tapered sealing surfaces.

Figure 5:
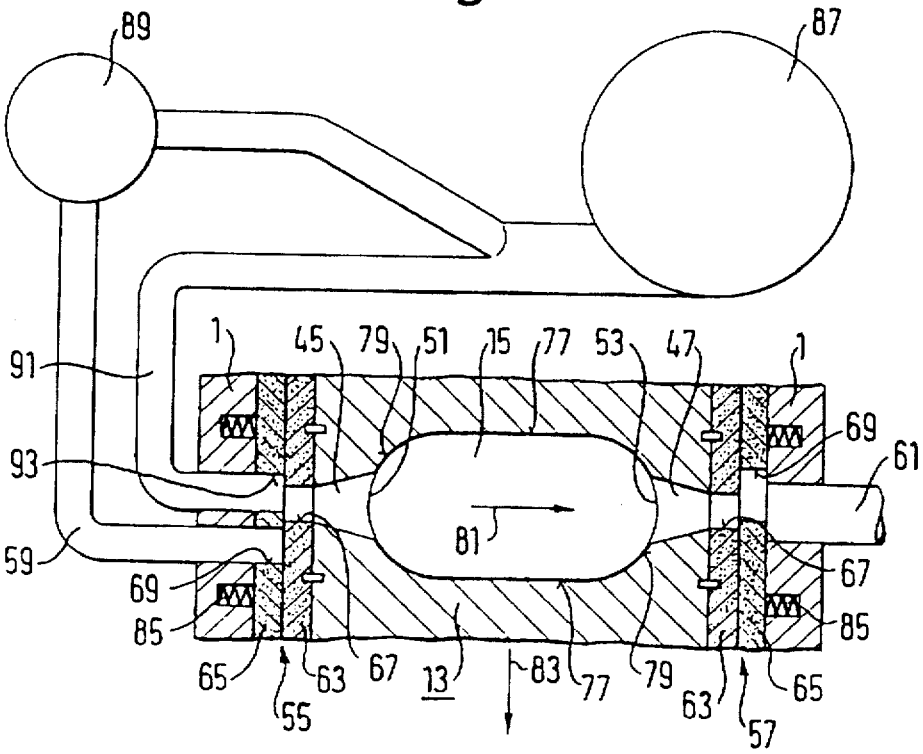
FIG. 5 a schematic representation of a variant of the internal combustion engine in FIGS. 1 and 2.

As a comparison of FIGS. 1 and 2 shows, the pistons 15 are narrower in the peripheral direction of the cylinder rotor 5 than in the direction of its axis of rotation 7. The width of the pistons 15 in both the peripheral and axial direction of the cylinder rotor 5 is greater than the stroke of the piston and hence greater than four times the eccentricity e. Thus comparatively narrow elongated combustion chambers 37 are produced between intake port 51 and exhaust port 52, which to support direct-flow scavenging are articulated curved by concave curvature of the cylinder cover 33 and convex curvature of the piston head 35. The pistons 15 may have a rectangular cross section or else, as represented in the example of FIG. 5, flat sides having planes in the peripheral direction which merge into one another at semicylindrical narrow sides. In this way eddy-forming corners and corners of combustion chambers unfavorable to combustion are avoided, especially when the intake and exhaust ports 51, 53 merge approximately tangentially into the piston-shaped cylinder walls.

Figure 4:
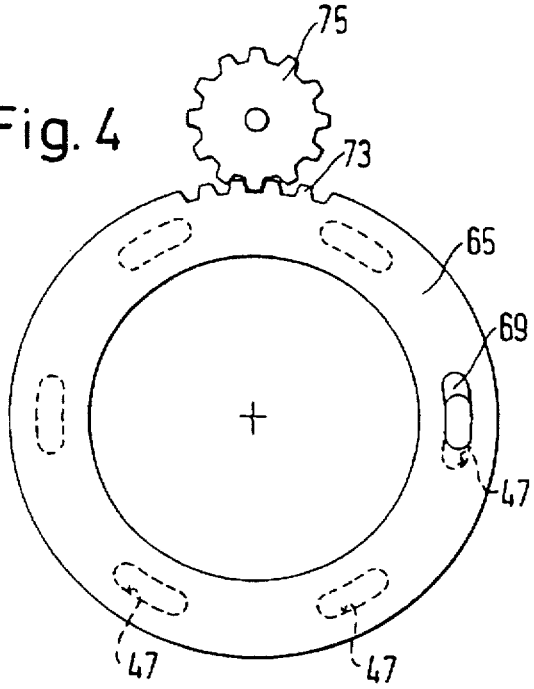
FIG. 4 a schematic representation of a rotary slide valve control arrangement usable in the internal combustion engine of FIGS. 1 and 2.

The sealing disks 63, 65 may be held fixed on the cylinder rotor 5 or the housing 1. In order optionally to be able to vary intake control times or exhaust control times, particularly the beginning of exhaust or the end of exhaust, independently of the piston-controlled ports, even during operation, in the example of FIG. 4 the housing-side control disk is seated for rotation on the housing 1 and provided with a toothing 73 on a part of its outer periphery. By means of a control gear wheel 75 meshing with the toothing 73, the overlapping angle of the opening 69 can be displaced relative to the housing-side gas-exchange channel, for example the exhaust channel 61, wherewith dependent upon the direction of displacement, the beginning of exhaust or the end of exhaust is shifted relative to the exhaust channels 47. Rotation of the sealing disk 65 may alternatively take place during operation of the engine.

FIG. 5, in a radial view, again shows details of the rotary slide valves 55, 57 and of the cross-sectional shape of the piston 15. The piston 15 has plane flat faces 77, parallel to one another and running in the peripheral direction, while the narrow side faces 79 of the piston have the shape of cylindrical sections with a semi-circular cross section. The intake channels 45 and exhaust channels 47 widen toward the cylinder and terminate approximately tangentially in the narrow side faces 79. The direction of scavenging of the combustion chamber is indicated by an arrow 81; the direction of motion of the cylinder 13 is indicated by an arrow 83. While the cylinder-side sealing disks 63 are mounted firmly on the cylinder rotor, the housing-side sealing disks 65 are supported axially movable on the latter and are preloaded toward the cylinder rotor by springs 85.

The combustion air is compressed by a blower 87, before fuel is admixed in a carburetor 89 or an injection pump and the air-fuel mixture is supplied to the combustion chambers through the intake channel 59. The intake rotary slide valve 55, as FIG. 5 shows, may additionally or alternatively be utilized for the control of beginning of intake or end of intake, and alternatively for control of a second intake channel 91 which, in the direction of rotation of the cylinder rotor before the opening 69 of the housing-side sealing disk 65, terminates in an additional opening 93 of this sealing disk. In this way the combustion chamber can first be scavenged with fresh air during each operating cycle before the combustion chamber is charged with air-fuel mixture. This reduces fuel losses due to scavenging. It is understood that, instead of the blower 87, a compressor or compressor arrangement of the type described in WO90/15918 with double-purpose pistons or the compressor explained below with the aid of FIGS. 9 and 10 may be used.

The cylinder rotor 5 is surrounded essentially completely by the housing 1. Since each of the cylinders 13 projects radially, the cylinder rotor 5 acts as a radial blower. At least on the side of the exhaust rotary slide valve 57, at least one cooling-air intake channel 95 (FIG. 1), which extends through a plurality of radial channels 97 distributed in the peripheral direction, past the exhaust rotary slide valve 57 into the inside of the housing 1, terminates radially within the central region of the housing 1 surrounded by the exhaust rotary slide valve 57. One or more cooling-air outlets 99, through which the cooling air exits, are provided in the region of the outer periphery of the housing. Owing to the supply of cooling air in the region of the exhaust rotary slide valve 57, the latter is cooled as a matter of priority. To improve heat exchange, the cylinders are provided with cooling fins in the usual way. It is understood that an additional blower may be connected upstream of the cooling-air channel 95.

The two-cycle internal combustion engine is alternatively suitable particularly for stationary operation since it has relatively small dimensions with a high output and, because of the low piston speed and short stroke, is long-lived. Sheathing by the housing 1 reduces the emission of noise. On its outer side the housing 1 may additionally be provided with soundproofing, indicated at 101. The internal combustion engine is especially suitable for stationary applications in connection with a machine 103, particularly the compressor of a heat pump system or an electric generator, especially a three-phase-current generator, coupled to the crankshaft 21. When used to drive a three-phase-current generator it matches the crankshaft speed doubled with respect to the speed of the rotor. The heat pump system advantageously is a component of a building heating system, to which the exhaust heat is also returned. A heat exchanger provided for this is indicated at 105 in FIG. 1.

Figure 6:
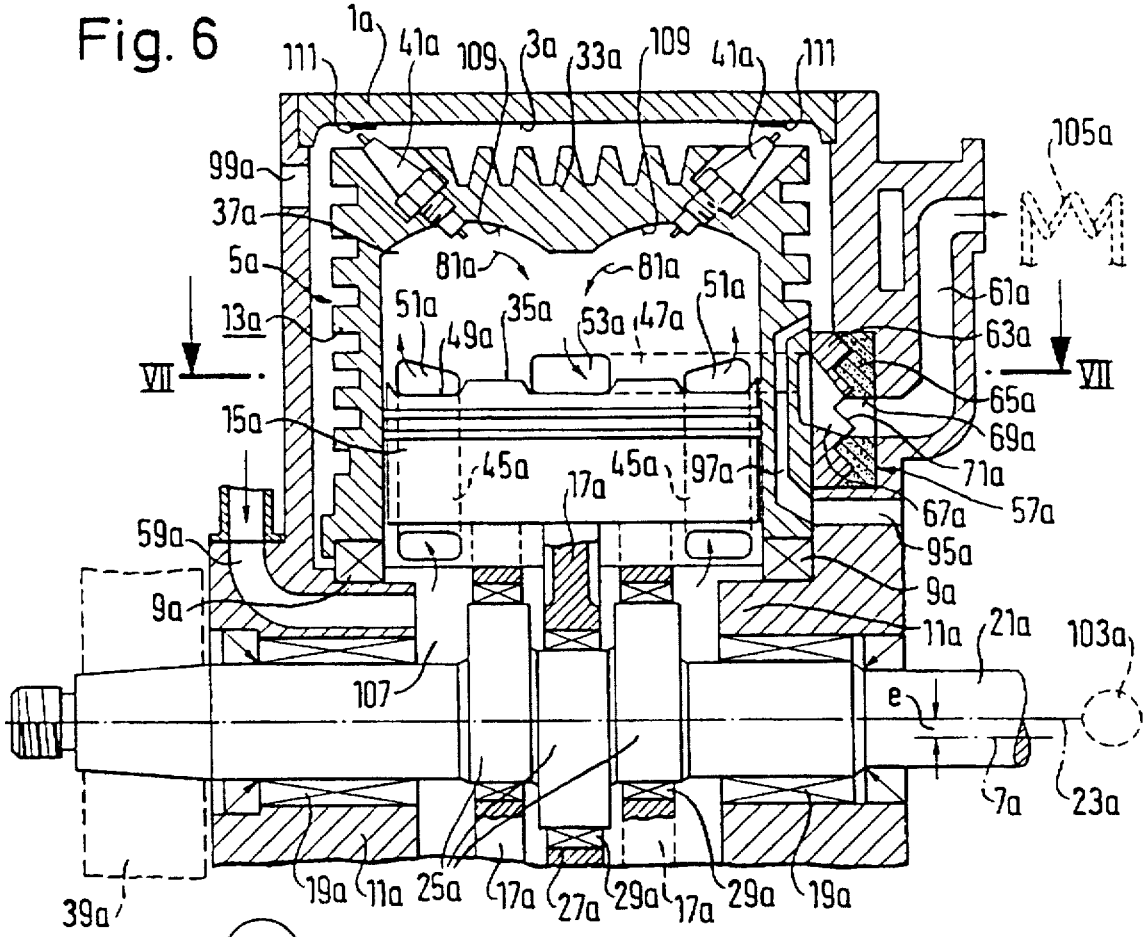
FIG. 6 a partial axial longitudinal section through a second embodiment of a two-cycle internal combustion engine of the rotary cylinder type according to the invention.
Figure 7:
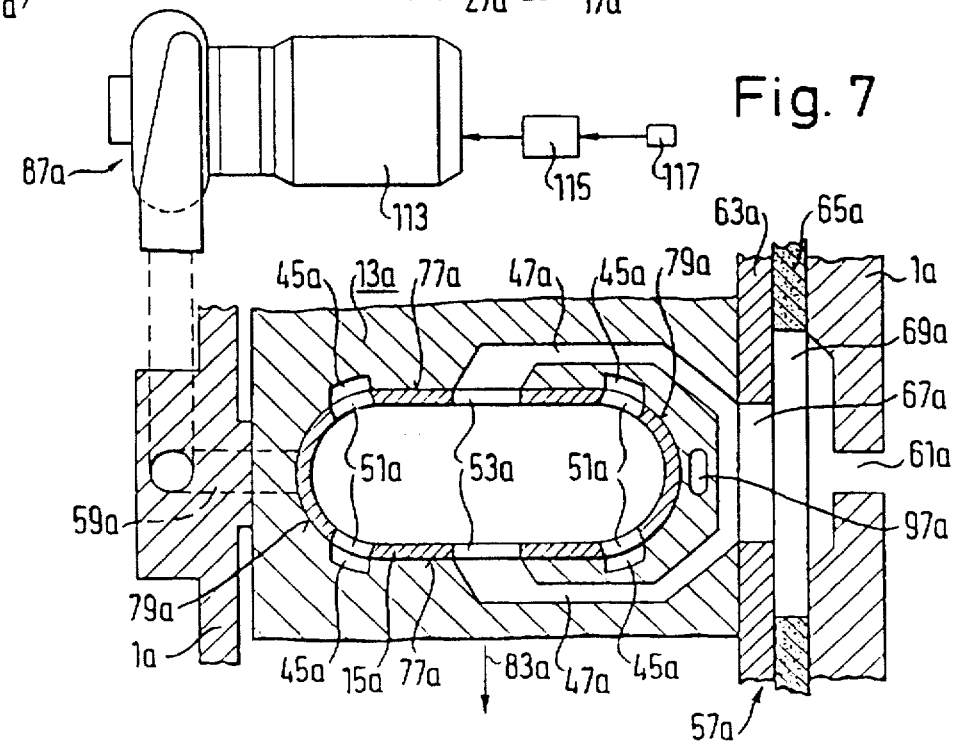
FIG. 7 a sectional view of the internal combustion engine, seen along a line VII—VII in FIG. 6.

FIGS. 6 and 7 show a variant of the two-cycle internal combustion engine described above, which differs from this engine primarily by the method of gas conduction. In FIGS. 6 and 7 like-acting parts with the reference numerals of FIGS. 1 to 5 are differentiated by addition of the letter a. Reference is made to the description of FIGS. 1 to 5 for explanation of the essential mode of operation of these components. The components 31, 32, 85, 89 and 101, as well as optionally the components 73 and 75, are present, but not represented, in FIGS. 6 and 7. The components 55, 91, 93 are not implemented.

The cylinder rotor **5*a* of the internal combustion engine represented in FIGS. 6 and 7 forms, radially within the chamber delimited by the piston 15*a*, a crank chamber 107 in which the intake channel 59*a* supplying the air-fuel mixture terminates. Here, the intake channel 59*a* runs radially through the housing 1*a* within the region surrounded by the bearing 9*a* of the cylinder rotor 5*a*. The cylinder-side intake channels 51*a* leading to the intake ports 51*a* are designed as overflow channels, the radial inner ends of which, on the side situated toward the crankshaft 21*a*, terminate outside the inner dead-center position of the piston 15*a* in the crank chamber 107. The pistons 15*a* are narrower in the peripheral direction of the cylinder rotor 5*a* than in the axial direction of the cylinder rotor 5*a*, and here too the narrow side width is greater than four times the value of the eccentricity e of the crankshaft 21*a*. The pistons 15*a* have plane flat sides 77*a*, running parallel to one another, and narrow sides 79*a* in the form of cylindrical sections with a semicircular cross section. In the axial centers of the flat sides 77*a* exhaust ports 53*a*, which are connected by separate exhaust channels 47*a* with the rotary slide valve 57*a* provided exclusively on the exhaust side, are provided in sides of the pistons 15*a* facing one another in the peripheral direction. As already described above, the gas exchange of the internal combustion engine, incidentally controlled by the piston edge 49*a* and the intake ports 51*a* and exhaust ports 53*a*, can be optimized by means of the exhaust rotary slide valve 57*a***.

The intake ports **51*a*, as well as the overflow channels 45*a*, are arranged in the region of the semi-cylindrical narrow sides of the pistons and are shaped so that the scavenging path 81*a* causes the fresh gases entering the combustion chamber 37*a* through the intake ports 51*a* to flow along the narrow side faces of the combustion chamber 37*a*, shaped in accordance with the piston 15*a*, to the cylinder cover 33*a*. The cylinder cover 33*a* contains two arches 109 lying side by side in the longitudinal direction of the piston, which return the fresh gas stream to the centrally arranged exhaust ports 53*a*. The elongated shape of the pistons 15*a*, in combination with the mode of arrangement of the ports 51*a*, 53*a* described above, permits reverse scavenging of the combustion chamber 37*a*. The internal combustion engine comprises two spark plugs 41*a*, each assigned to one of the arches 109, which provide symmetrical ignition and are connected by spark contact strips 111, arranged on the inner surface of the housing 1*a***, with an ignition system not represented in detail.

The blower **87*a* delivering the fresh air is driven by an electric motor 113, the speed of which can be varied by a control 115. The control 115, which optionally detects the actual speed of the cylinder rotor 5*a* or of the crankshaft 21*a* by means of a speed sensor 117, controls the boosting pressure and hence the degree of fill of the combustion chambers 37*a* through the speed of the electric motor 113. Suitable adjustment of the degree of fill makes it possible for some of the exhaust gases to be retained in the combustion chamber 37*a* and thus to be supplied for combustion anew in the next operating cycle, to reduce the emission of pollutants from the internal combustion engine. This makes recycling of exhaust gases unnecessary. Instead of the electric motor 113, some other variable-speed motor may alternatively may be used, for example a hydraulic motor or the like. The components 113 to 117 may alternatively be used in an internal combustion engine of FIGS. 1 to 5. On the other hand, the internal combustion engine of FIGS. 6 and 7 may be augmented by the components 103, 105**. The designs of the rotary slide valves described with the aid of FIGS. 1 to 5 may alternatively be used in the internal combustion engine of FIGS. 6, 7. The same thing applies to the design of the engine cooling.

Figure 8:
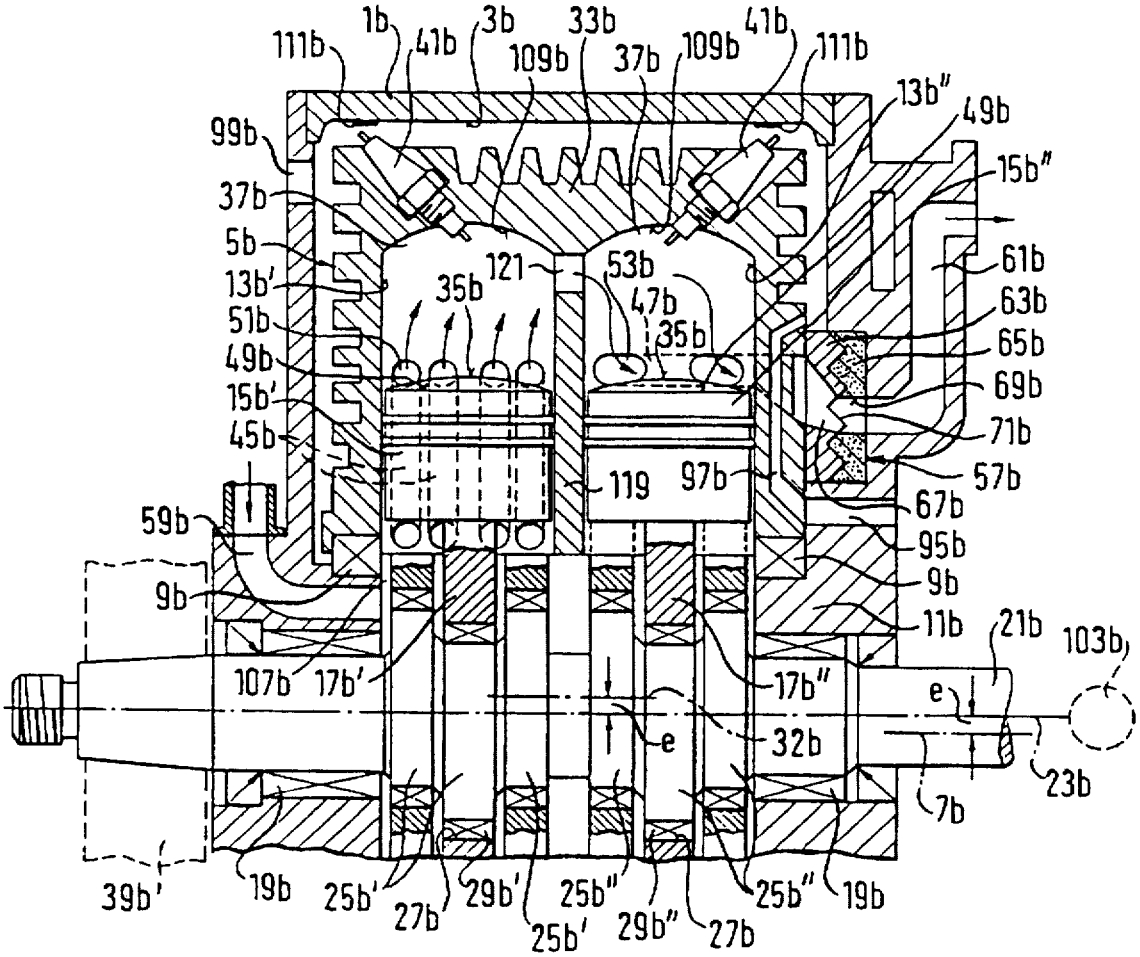
FIG. 8 a partial axial longitudinal section through a third embodiment of a two-cycle internal combustion engine according to the invention.

FIG. 8 shows a variant of the two-cycle internal combustion engine of FIGS. 6 and 7. Here, too, like-acting parts with the reference numerals of FIGS. 1 to 7 are differentiated by the addition of the letter b. For the explanation of these components, reference is made to the description of FIGS. 1 to 5 and, in particular, of FIGS. 6 and 7.

The two-cycle internal combustion engine of FIG. 8 differs from the engine of FIGS. 6 and 7 primarily in that, instead of a single piston per cylinder, elongated in the axial direction of the cylinder rotor, a double piston consisting of two partial pistons 15b' and 15b" is provided. The partial pistons 15b' and 15b" have a circular cylindrical cross section and are arranged for displacement on axes parallel to one another, in two cylinder chambers 13b' and 13b" arranged side by side in the axial direction of the cylinder rotor 5b. The cylinder chambers 13b' and 13b" are partitioned off from one another by a separating wall 119 which, in the region of the common cylinder cover 33b, is provided with at least one overflow opening 121 connecting the combustion chambers 37b. The cylinder cover 33b is turned toward the combustion chambers 37b and in each instance is provided with arches 109b for the accommodation of spark plugs 41b. The circular cylindrical shape of the cylinder chambers 13b', 13b", as well as of the partial pistons 15b', 15b" of the double-piston arrangement, facilitates sealing, without the stroke volume capable of accommodation in the cylinder rotor 5b having to be reduced or the diameter of the cylinder rotor 5b having to be enlarged.

The air-fuel mixture supplied through the intake channel 59b flows through the crank chamber 107b and a plurality of overflow channels 45b', arranged in the peripheral direction of the cylinder rotor 5b on both sides of one of the two partial pistons, here of the partial piston 15b', in the combustion chamber 37b of this partial piston. The radial outer piston edge 49b of the partial piston 15b' controls the intake ports 51b of the assigned cylinder chamber 13b'.

The other partial piston 13b" is used exclusively for the control of exhaust ports 53b of the other cylinder chamber 13b". The exhaust ports 53b are again arranged in the peripheral direction of the cylinder rotor 5b on either side of the piston 15b". Exhaust gas-exchange channels 47b connect the exhaust ports 53b with the rotary slide valve 57b provided exclusively on the exhaust side and hence with a housing-side stationary exhaust channel 61b, as is explained in detail with the aid of FIGS. 6 and 7.

In distinction to the internal combustion engines of FIGS. 1 to 7, separate piston rods 17b' and 17b" are alternatively assigned to the partial pistons 15b' and 15b" in each instance. The two piston rods 17b' and 17b" of the double piston are arranged in the axial direction of the cylinder rotor 5b at a distance apart from one another and are supported on eccentric circular disks 25b' and 25b", likewise arranged at some distance apart. The eccentric circular disks 25b' and 25b" again are seated in needle bearings 19b in bearing openings 27b of the piston rods. Similarly to the internal combustion engines of FIGS. 1 to 7, each of the partial pistons 15b' and 15b" is rigidly connected with a corresponding partial piston of the double piston arranged on the opposite side of the axis of rotation 7b of the cylinder rotor 5b. Here, the eccentric axes of rotation defined by the eccentric circular disks 25b' and 25b" of the double piston pair run coaxially.

The variants of the engine explained in connection with FIGS. 6 and 7 may alternatively be provided in the internal combustion engine of FIG. 8. It is understood that the double-piston principle may alternatively be used in the engine of FIGS. 1 to 5.

Figure 10:
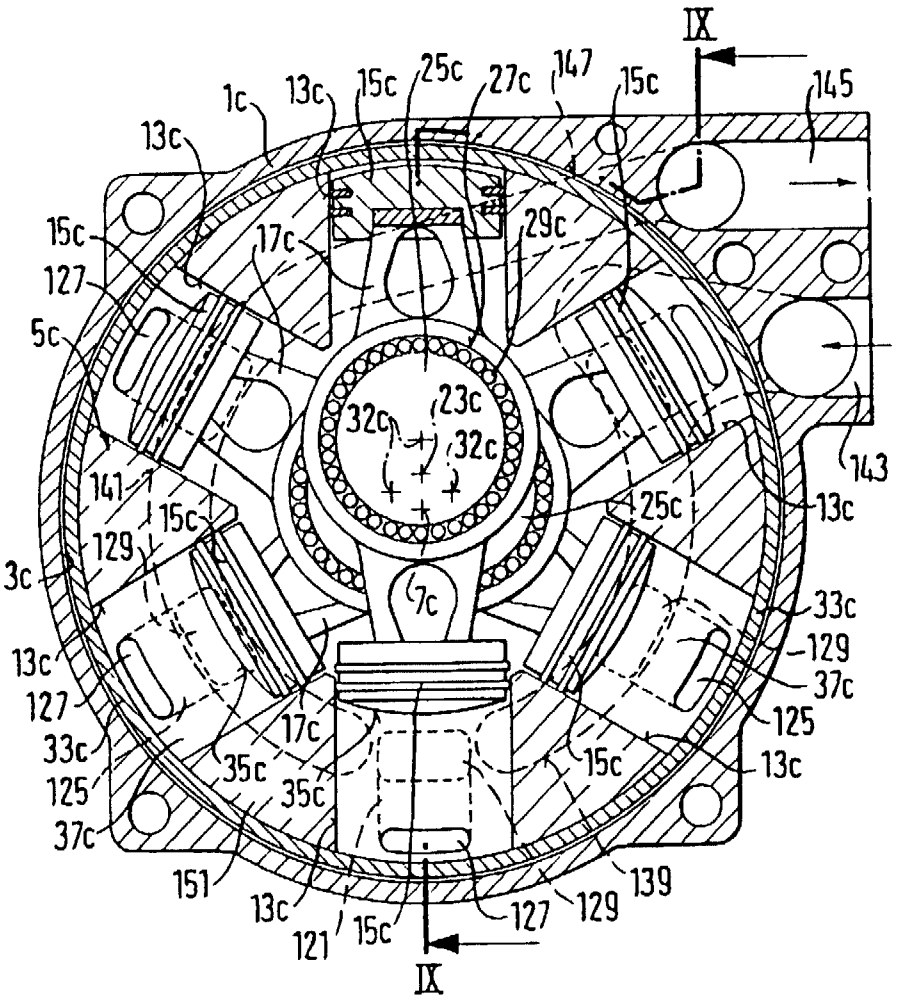
Figure 9:
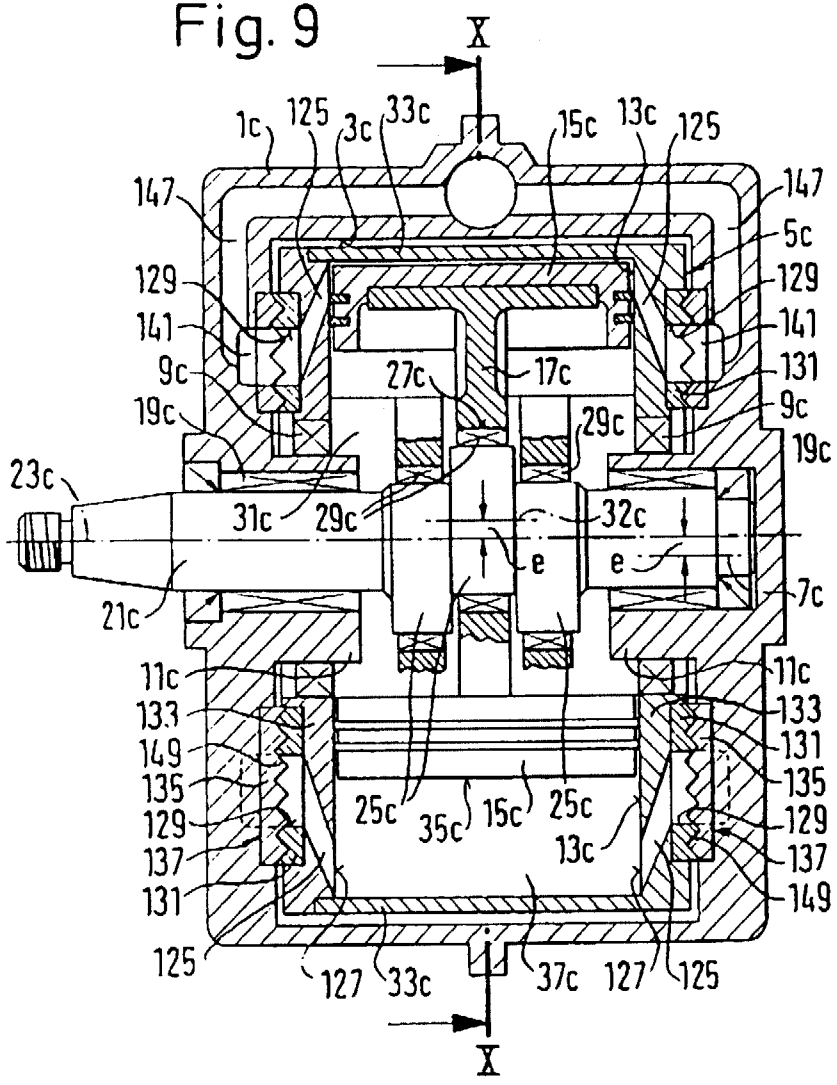
FIG. 9 an axial longitudinal section through a compressor of the rotary cylinder type according to the invention, seen along a line IX—IX in FIG. 10 and FIG. 10 an axial cross section through the compressor, seen along a line X—X in FIG. 9.

FIGS. 9 and 10 show a compressor of the rotary cylinder type in which the arrangement of the cylinders and pistons and the kinematic motion is selected according to the rotary cylinder machines of FIGS. 1 to 8. For explanation of the design and mode of operation of the components with the reference numerals 1 to 37 in particular, reference is made to the description of these figures, in particular of FIGS. 1 to 5, the reference numerals being differentiated by the letter c. Components which are specifically for internal combustion engines, such as, for example, spark plugs or the like, are omitted, and instead of combustion chambers the pistons and cylinders delimit compressor chambers. The pistons 15c are designed as pistons elongated in the axial direction of the cylinder rotor 5c, in cross section preferably as rectilinearly delimited rectangular pistons; instead of such pistons, the double-piston arrangement of FIG. 8 may alternatively find use.

The cylinder rotor 5c, on axially opposing sides, in each instance comprises one or a plurality of gas-exchange channels 125 assigned to the individual cylinders 13c, which channels, through ports 127 near the cylinder cover 33c firmly connected with the individual cylinder 13c, terminate in the compressor chamber 37c delimited by the cylinder 13c and the piston 15c. The gas-exchange channels 125 run in the walls of the cylinder rotor 5c and end at a region, situated radially further inside with reference to the ports 127, in openings 129 of sealing disks 131, which are connected with side walls 133 of the cylinder rotor 5c running fixed against rotation and perpendicular to the axis of rotation 7c. Each of the two sealing disks 131, together with an additional sealing disk 135 connected fixed against rotation with the housing 1c, forms a rotary slide valve designated generally 137, which controls the gas intake and the gas exhaust of the compressor upon rotation of the cylinder rotor 5c relative to the housing 1c. The sealing disk 135, optionally together with the side wall of the housing 1c adjacent to it, forms two control ports 139 and 141 (FIG. 10) surrounding the axis of rotation 7c circularly, one of which, here the control port 139, in each instance forms an intake control port and connects the opening 129 with a common intake opening 143, while the other control port 141 forms an exhaust control port and connects the openings 129 with a common exhaust opening 145. The overlapping region covered in the course of rotation of the cylinder rotor 5c between the openings 129 on one hand and the control ports 139, 141 on the other determines the suction phase and the exhaust phase of the compressor.

As FIG. 9 shows for the control ports 141, these are tied in together through channels 147 to the exhaust opening 145. The control ports 139 likewise are correspondingly connected with the common intake opening 143. Here the openings 143, 145 lie in a plane perpendicular to the axis of rotation 7c, along which the housing 1c is divided into two housing halves mirror-symmetrical to the plane. Here the location of the channels is selected so that the openings 143, 145 lie close together.

The above design of the housing 1c facilitates its manufacture. Since the gas-exchange channels 125c run radially inward from the region of the cylinder covers 33c, the rotary slide valves 137 can be arranged on a comparatively small diameter, which reduces the relative rotational speed of the two sealing disks 131, 135. The sealing disks are provided on their faces resting on one another with interlocking concentric ribs or grooves 149, which jointly form a labyrinth seal. Since the sealing disks 131, 135 are pressed against one another either because of their intrinsic elasticity or due to preloading by springs acting axially, sufficient sealing of the compressor chambers 37*c* can be obtained. Particularly of advantage is the fact that, owing to the cylinder covers 33*c* firmly connected with the cylinder rotor, no seals are required at the outer periphery of the cylinder rotor 5*c*.

The cylinder rotor 5*c* is composed essentially of two components, of which one comprises one of the side walls 133 and the peripheral wall at the same time forming the cylinder covers 33*c* and the other component in each instance comprises the other side wall 133 as well as projections 151 projecting from the latter, which form the walls of the cylinder 13*c* situated in the peripheral direction. Components of this type can be produced comparatively simply and exactly, since they have essentially no undercuts.

The compressor described above may be driven by any desired driving device, but preferably is coupled with an internal combustion engine according to FIGS. 1 to 8 and utilized for precompression of air and/or air-fuel mixture.

I claim:

1. A rotary cylinder two-cycle internal combustion engine, comprising a housing, a cylinder rotor mounted in the housing for rotation about a first axis of rotation, defining a central crankshaft chamber and having three pairs of cylinders located outwardly of the crankshaft chamber, each cylinder being closed at a radially outer end by a cylinder cover affixed to the cylinder rotor, and the cylinders of each pair being arranged coaxially on opposite sides of the first axis of rotation on common cylinder axes disposed radially of the first axis of rotation and displaced at an angle of 120° with respect to one another, a crankshaft mounted in the housing for rotation about a second axis of rotation that is parallel to the first axis of rotation and is spaced apart from the first axis of rotation by an eccentricity (e), the crankshaft carrying three eccentric bearings defining three third axes of rotation that are spaced apart from each other at an angle of 120° with respect to the second axis of rotation, parallel to the second axis of rotation, and spaced apart from the second axis of rotation by the eccentricity (e), a piston received in each cylinder for displacement along the respective cylinder axis and defining with the cylinder cover a combustion chamber, the pistons in each pair of cylinders being substantially rigidly connected together by means of piston rods that are received by corresponding eccentric bearings of the crankshaft, and a gas-exchange control arrangement having intake and exhaust gas-exchange channels communicating separately with the individual cylinders, one end of each channel terminating in at least one gas-exchange port in the cylinder which is controllable by a radially outer edge of the piston, each of the intake gas-exchange channels being formed as an overflow channel that opens to the crankshaft chamber, and the gas-exchange control arrangement further having a gas intake channel passing through the housing within a bearing supporting the cylinder rotor for rotation on the housing and communicating with the crankcase chamber.

2. A rotary cylinder engine according to claim 1, wherein the gas-exchange control arrangement further has rotary slide valve control means operating synchronously with the cylinder rotor and interposed between an exhaust gas-exchange channel section that is stationary relative to the housing and a cylinder-side exhaust gas-exchange channel for controlling the exhaust gas exchange by changing the exhaust opening control angle of the cylinder-side exhaust gas-exchange channel relative to the rotation of the cylinder rotor compared with the exhaust opening control angle of the cylinder-side exhaust gas-exchange ports.

3. A rotary cylinder engine according to claim 1, wherein the pistons are wider in the direction of the first axis of rotation than in a direction that is circumferential with respect to the first axis of rotation, wherein the exhaust gas-exchange ports are provided in generally the centers of side walls of the cylinders that run substantially in the axial direction of the cylinder rotor, and wherein the intake gas-exchange ports are located at axial end regions of the cylinder rotor on opposite sides of the exhaust gas-exchange ports.

4. A rotary cylinder engine according to claim 3, wherein the intake gas-exchange channels are arranged so that the intake gases in the region of the side walls of the cylinder rotor flow generally toward the cylinder cover.

5. A rotary cylinder engine according to claim 4, wherein each cylinder cover has two concavely curved arches lying side by side in the axial direction of the cylinder rotor.

6. A rotary cylinder engine according claim 3, wherein each of the cylinders has exhaust gas-exchange ports and intake gas-exchange ports in both side walls.

7. A rotary cylinder engine according to claim 1, wherein each cylinder has two circular cylindrical cylinder chambers arranged side by side in the axial direction of the cylinder rotor, which are separated from one another by a separating wall, the separating wall of each cylinder having in the region of the cylinder cover at least one overflow opening, wherein one of the two cylinder chambers of each cylinder is connected only with the intake gas-exchange channel and the other cylinder chamber of each cylinder is connected only with the exhaust gas-exchange channel, and wherein one of two partial pistons of a double piston is received in each cylinder chamber.

8. A rotary cylinder engine according to claim 7, wherein each chamber of each cylinder is defined by side walls of the cylinder rotor on opposite sides of a plane that includes the cylinder axis and the first axis of rotation, at least one side wall of each said one chamber of each cylinder has overflow channels, and at least one side wall of each said other chamber of each cylinder has gas-exchange ports.

9. A rotary cylinder engine according to claim 7, wherein the two partial pistons of each double piston are connected by separate partial piston rods with the two partial pistons of the double piston in radially opposed positions relative to the first axis of rotation, the two partial piston rods of each double piston pair being supported on two eccentric bearings arranged in spaced apart relation in the direction of the second axis of rotation.

10. A rotary cylinder engine according to claim 7, wherein the gas-exchange control arrangement further has rotary slide valve means operating synchronously with the cylinder rotor and including an exhaust gas-exchange channel section that is stationary relative to the housing and a cylinder-side exhaust gas-exchange section carried by the cylinder rotor for successively communicating each exhaust gas-exchange channel to the outside of the housing in a predetermined region of the angle of rotation of the cylinder rotor.

* * * * *